US005326467A

United States Patent [19]

Shong et al.

[11] Patent Number: 5,326,467

[45] Date of Patent: Jul. 5, 1994

[54] RECOVERING POLYCHLORINATED BIPHENYLS FROM SOLUTION

[75] Inventors: Robert G. Shong, Houston; Robert L. Horton, The Woodlands, both of Tex.

[73] Assignee: Texaco Inc., White Plains, N.Y.

[21] Appl. No.: 997,055

[22] Filed: Dec. 28, 1992

[51] Int. Cl.[5] ..... C10G 29/06

[52] U.S. Cl. ..... 208/262.5; 588/207; 210/909; 134/25.1

[58] Field of Search ..... 208/262.5; 210/909; 134/25.1; 588/207

[56] References Cited

U.S. PATENT DOCUMENTS 4,351,718 9/1982 Brunelle ..... 588/207

4,612,404 9/1986 Thyagarajan ..... 588/207

*Primary Examiner*—Helane Myers
*Assistant Examiner*—Walter D. Griffin
*Attorney, Agent, or Firm*—James L. Bailey; Kenneth R. Priem; Harold J. Delhommer

[57] ABSTRACT

A method of recovering polychlorinated biphenyls from solution, which comprises a multi-step method of mixing and reacting an alkali metal or alkaline earth hydroxide in glycol solution with polychlorinated biphenyls in non-aqueous solvent to form biphenyl phenoxy-type anions, separating the glycol solution containing biphenyl phenoxy-type anions from the non-aqueous solvent, and separating the biphenyl phenoxy-type anions from the glycol solution.

10 Claims, No Drawings

RECOVERING POLYCHLORINATED BIPHENYLS FROM SOLUTION

BACKGROUND OF THE INVENTION

This invention relates to the recovery of a hazardous class of chemicals referred to as polychlorinated biphenyls. More particularly, the invention concerns the recovery of polychlorinated biphenyls from solution by reaction and then extraction into glycol.

Compounds likely to accompany polychlorinated biphenyls in contaminated sites include polychlorinated alkylbiphenyls, polychlorinated polyalkylbiphenyls, polychlorinated triphenyls, polychlorinated oligo-phenyls, and polychlorinated polyphenyls, and metabolites of polychlorinated biphenyls, polychlorinated triphenyls, polychlorinated oligo-phenyls, and polychlorinated polyphenyls and others. The terms "PCB" and "polychlorinated biphenyls" as used herein are intended to be synonymous broad terms, including not only polychlorinated biphenyls themselves, but also related compounds which may accompany polychlorinated biphenyls in various processes or at contaminated sites.

PCB was known before the turn of the century. Although the useful industrial properties of mixtures obtained by chlorination of biphenyl were recognized early, PCB is relatively unreactive chemically. Therefore, from a purely chemical point of view, PCB is a rather uninteresting class of compounds. Limited attention was paid to them by the scientific community. However, in the mid 1960's, several publications noted the widespread occurrence of these compounds in the environment and the following events led to a dramatic upsurge of attention to PCB. It is now established that because of its lipid solubility (lipophilicity) and resistance to degradation, PCB accumulates in food chains and is distributed worldwide, like chlorinated pesticides such as DDT.

The literature on PCB is growing rapidly due to concern about PCB contamination of the environment. One result has been strict United States EPA standards on contamination. However, the removal of PCB from food chains is just one example of a broad need for methods of recovery of trace PCB contaminants from dilute aqueous and non-aqueous solution.

Prior art procedures for recovery of PCB include a variety of methods. One solution has been the reaction of PCB with hydroxylating agents. Unfortunately, such procedures are not always capable of effectively contacting and recovering PCB, especially when PCB is present only in trace quantities or in dilute solution. Furthermore, current PCB recovery strategies are expensive in terms of energy demand and time.

U.S. Pat. No. 4,619,744 teaches that heavy metals can be efficiently recovered from aqueous solutions by several novel methods involving interaction of the metals with water-soluble polymers. Unfortunately, the interactions between PCB and polymers are quite unlike those between heavy metals and polymers. Therefore, while a similar approach applicable to PCB was imagined at the time of the invention which led to U.S. Pat. No. 4,619,744, no such approach was found by the inventors. This resulted in part from the extreme unreactivity of PCB. A contributing factor was the hydrophobicity of PCB. Polymers which are soluble in non-aqueous solvents and have functional groups capable of reacting with PCB have been difficult to find.

Copending U.S. patent application Ser. No. 07/828,622 filed Jan. 31, 1992, discloses a method of recovering PCB from non-aqueous solution by mixing and reacting a soluble polymer with a PCB solution to form a precipitate reaction complex. The polymer has the formula

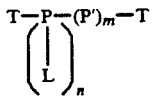

SUMMARY OF THE INVENTION

The invention is a method of recovering polychlorinated biphenyls from solution, which comprises a multi-step method of mixing and reacting an alkali metal or alkaline earth hydroxide in glycol solution with polychlorinated biphenyls in non-aqueous solvent to form biphenyl phenoxy-type anions, separating the glycol solution containing biphenyl phenoxy-type anions from the non-aqueous solvent, and separating the biphenyl phenoxy-type anions from the glycol solution.

DETAILED DESCRIPTION

We have discovered that PCB contaminants can be recovered from non-aqueous solutions by reaction with a hydroxide and subsequent extraction of the reaction product into a glycol solution. Separation of the PCB/hydroxide reaction product from the glycol solution may be accomplished by a precipitation reaction to increase the molecular weight of the reaction product to yield a precipitate.

The present invention provides novel methods for the recovery of PCB with molecular weights as low as about 180 to well over 600 from sites of contamination and from non-aqueous solutions containing PCB. This includes PCB compounds having as few as two phenyl groups and two chlorine substituents through those PCB compounds having many phenyl groups and chlorine substituents.

The initial step of the invention involves mixing and reacting an alkali metal or alkaline earth hydroxide in a glycol solution with PCB in non-aqueous solvent to form biphenyl phenoxy-type anions. The two solutions must be mixed so that the hydroxide achieves sufficiently intimate contact to react with the PCB. A dispersal of PCB solution as finally divided droplets into the glycol solution is one possibility. Others known to those skilled in the art may be used. The proportion of glycol to non-aqueous solvent is preferably in the range of about 0.5/1 to about 3/1, most preferably about 1/1 to about 2/1.

The non-aqueous solvent must provide for dissolution of PCB, or provide for intimate contact between the hydroxide in glycol solution and PCB in order for reaction to occur. Toluene is a preferred solvent. Other possible solvents are natural gas liquids, gas condensate, petroleum ether, mixed pentanes, n-pentane, cyclopentane, methylcyclopentane, mixed hexanes, n-hexane, cyclohexane, methylcyclohexane, naphtha, benzene, toluene, xylene and mixtures thereof.

Several of the non-aqueous solvents, including toluene, perform well in collecting PCB from sites of contamination by solvent washing of the site. Multiple washings may be necessary to remove most of PCB contamination from a site. The invention method works well with a concentration of PCB in solution between about 10 ppm and about 15,000 ppm, but this is not an exclusive range.

The term glycol solution includes ethylene glycol, diethylene glycol, triethylene glycol, tetraethylene glycol, propylene glycol and mixtures thereof. The average molecular weight of the glycol solution should be about 200 to about 1500.

The alkali metal and alkaline earth hydroxides solvated in the glycol solution may be sodium hydroxide, potassium hydroxide, lithium hydroxide, calcium hydroxide, magnesium hydroxide, barium hydroxides, ammonium hydroxide (included in the above list by definition herein), and mixtures thereof.

One means of separating reaction product is by precipitation. A preferred precipitation is caused by the a addition of polydimethyldiallyl ammonium hydroxide to the glycol solution. Once the PCB reaction product has been precipitated, the precipitate can conveniently be recovered by any suitable technique known to those skilled in the art, such as filtration, centrifugation, liquid decantation, and the like. It may be desirable to recover the PCB contaminants from the precipitate to reduce waste disposal volume. PCB can be extracted from the concentrated solution by other techniques such as extraction, and the glycol solution recycled.

Other means of separation known to those skilled in the art may be employed. Reaction product may also be removed by passing the solution through an ion exchange column packed with a strong acid type solid ion exchange resin having an affinity for the reaction product, or by passing the solution through an activated carbon bed, both being capable of producing a substantially clean glycol solution for recycle.

After separation, the PCB contaminant can be destroyed by means well known to one skilled in the art. Alternatively, the PCB/hydroxide reaction product separated from the glycol can be left intact and in the location of its occurrence, or collected and subjected either to perpetual containment or to destruction. Thus, the method has varying options to concentrate PCB contaminants into a more manageable volume.

The following hypothetical example will further illustrate the present invention of recovering polychlorinated biphenyls. This example is given by way of illustration and not as a limitation on the scope of the invention. Thus, it should be understood that procedures and amounts may be varied with the process still remaining within the scope of the invention.

EXAMPLE I

A site of PCB contamination is washed with toluene, producing a toluene solution containing about 10,000 ppm PCB. The PCB toluene solution is dispersed as finely divided droplets into an excess of suitably prepared sodium hydroxide solution in ethylene glycol, the two solutions achieving sufficiently intimate contact for the hydroxide to react with the PCB, producing biphenyl phenoxy-type anions. The anions tend to partition into the glycol phase.

The two liquids are separated and the dilute biphenyl phenoxy-type anions are precipitated form the glycol solution by reaction with very small amounts of added polydimethyldiallylammonium hydroxide. The glycol solution is recycled for further contact and reaction with the PCB toluene solution until the PCB concentration is sufficiently attenuated. The toluene is used again to wash the site of PCB contamination and further remove the PCB contaminants.

Many other variations and modifications may be made in the concepts described above by those skilled in the art without departing from the concept of the present invention. Accordingly, it should be clearly understood that the concepts disclosed in the description are illustrative only and are not intended as limitations on the scope of the invention.

What is claimed is:

1. A method of recovering polychlorinated biphenyls from solution, which comprises:

mixing and reacting an alkali metal or alkaline earth hydroxide in glycol solution with polychlorinated biphenyls in non-aqueous solvent to form biphenyl phenoxy anions;

separating the glycol solution containing biphenyl phenoxy anions from the non-aqueous solvent; and separating the biphenyl phenoxy anions from the glycol solution by mixing and reacting polydimethyldiallyl ammonium hydroxide with said anions to precipitate said anions from glycol solution.

2. The method of claim 1, wherein the glycol solution comprises ethylene glycol, diethylene glycol, triethylene glycol, tetraethylene glycol, propylene glycol, or mixtures thereof.

3. The method of claim 1, wherein the ratio of glycol solution to non-aqueous solvent is about 0.5/1 to about 3/1.

4. The method of claim 1, wherein the ratio of glycol solution to non-aqueous solvent is about 1/1 to about 2/1.

5. The method of claim 1, wherein the alkali metal or alkaline earth hydroxide is sodium hydroxide, potassium hydroxide, lithium hydroxide, calcium hydroxide, magnesium hydroxide, barium hydroxide, ammonium hydroxide or a mixture thereof.

6. The method of claim 1, wherein the average molecular weight of the glycol solution is about 200 to about 1500.

7. The method of claim 1, wherein the non-aqueous solvent is toluene, xylene, natural gas liquids, gas condensate, petroleum ether, mixed pentanes, n-pentane, cyclopentane, methylcyclopentane, mixed hexanes, n-hexane, cyclohexane, methylcyclohexane, naphtha, benzene, or mixtures thereof.

8. The method of claim 1, further comprising repeating the steps of mixing and reacting and separating the glycol solution from the non-aqueous solvent.

9. The method of claim 1, wherein the concentration of polychlorinated biphenyls in solution is between about 10 ppm and about 15,000 ppm.

10. A method of recovering polychlorinated biphenyls from solution, which comprises:

mixing and reacting sodium hydroxide in glycol solution with polychlorinated biphenyls in toluene to form biphenyl phenom anions;

separating the glycol solution containing biphenyl phenoxy anions from the toluene; and mixing and reacting polydimethyldially ammonium hydroxide with said anions to precipitate said anions from glycol solution.

* * * * *

UNITED STATES PATENT AND TRADEMARK OFFICE

CERTIFICATE OF CORRECTION

PATENT NO. : 5,326,467

DATED : July 5, 1994

INVENTOR(S) : Robert George Shong and Robert Louis Horton

It is certified that error appears in the above-identified patent and that said Letters Patent is hereby corrected as shown below:

In Claim 10, column 4, line 59, please substitute --phenoxy-- for "phenom".

Signed and Sealed this

Twenty-second Day of November, 1994

*Attest:*

*Attesting Officer*

Bruce Lehman

BRUCE LEHMAN

*Commissioner of Patents and Trademarks*